US006498543B2

(12) United States Patent
Kim et al.

(10) Patent No.: US 6,498,543 B2
(45) Date of Patent: Dec. 24, 2002

(54) MONOBLOCK DIELECTRIC DUPLEXER

(75) Inventors: Hyun Jai Kim, Kangnam-gu (KR); Seok Jin Yoon, Dobong-gu (KR); Ji Won Choi, Seongdong-gu (KR); Chong Yun Kang, Seocho-gu (KR); Hyeung Kwon Choi, Suncheon-si (KR)

(73) Assignee: Korea Institute of Science and Technology, Seoul (KR)

( * ) Notice: Subject to any disclaimer, the term of this patent is extended or adjusted under 35 U.S.C. 154(b) by 0 days.

(21) Appl. No.: 09/883,259

(22) Filed: Jun. 19, 2001

(65) Prior Publication Data

US 2002/0030557 A1 Mar. 14, 2002

(30) Foreign Application Priority Data

Jun. 19, 2000 (KR) ..... 2000-33546

(51) Int. Cl.[7] ..... H01P 1/213
(52) U.S. Cl. ..... 333/134; 333/202; 333/206
(58) Field of Search ..... 333/134, 202, 333/206

(56) References Cited

U.S. PATENT DOCUMENTS 4,431,977 A 2/1984 Sokola et al.
4,742,562 A * 5/1988 Kommrusch ..... 333/134
4,823,098 A 4/1989 Demuro et al.
4,829,274 A 5/1989 Green et al.
4,954,796 A 9/1990 Green et al.
5,109,536 A 4/1992 Kommrusch
5,146,193 A 9/1992 Sokola
5,162,760 A 11/1992 Phillips et al.
5,712,648 A 1/1998 Tsujiguchi
2001/0008388 A1 * 7/2001 Jun et al. ..... 333/202

FOREIGN PATENT DOCUMENTS

KR 99-14343 2/1999

* cited by examiner

*Primary Examiner*—Don Phu Le
(74) *Attorney, Agent, or Firm*—Oblon, Spivak, McClelland, Maier & Neustadt, P.C.

(57) ABSTRACT

A monoblock dielectric duplexer comprises resonant holes. Conductive electrodes and couplers are formed on one side of the dielectric block, whose other sides are covered with a conductive material. The conductive electrodes in a transmit-filtering portion are formed in an inter-digitating manner while the conductive electrodes in receive-filtering portion are formed to be of pad-shape. In the duplexer, capacitances of capacitors comprised of the conductive electrodes are easily and accurately set to desired values by determining the number and/or the lengths of fingers that the inter-digitating electrodes have.

8 Claims, 6 Drawing Sheets

MONOBLOCK DIELECTRIC DUPLEXER

FIELD OF THE INVENTION

The present invention generally relates to a monoblock dielectric duplexer, and more particularly, to patterns of conductive electrodes on a monoblock dielectric duplexer that can accurately and simply set the capacitances of capacitors in the duplexer.

BACKGROUND OF THE INVENTION

A duplexer is used in a communications device to pass transmission signals and received signals in different frequency bands. A monoblock dielectric duplexer is one of various types of duplexers widely used in the art. The monoblock dielectric duplexer comprises a block of a dielectric material. A plurality of resonant holes are made inside the dielectric block like tunnels from one surface to its opposite surface in parallel. They are at given distances from one anther in the dielectric block. The internal surface of each of the resonant holes is substantially covered with conductive materials to form a resonator. In addition, a plurality of conductive electrodes usually in the shape of a square-shape are formed on the surroundings of the openings of the plurality of the resonant holes on the front surface of the dielectric block. Each of the conductive electrodes is connected to the conductive material covering the internal surface of each of the resonant holes.

The monoblock dielectric duplexer typically comprises a transmit-filtering portion and a receive-filtering portion, wherein the frequency band of the transmit-filtering portion relatively is lower than that of the receive-filtering portion. The former consists of a first group of resonant holes, and has characteristics of passing transmitting frequencies while attenuating receiving frequencies. On the other hand, the latter consists of a second group of resonant holes, and has characteristics of passing the receiving frequencies while suppressing the transmitting frequencies. Besides, patterns of input and output terminals are disposed in the right and left ends of the front surface, respectively. An antenna terminal is disposed between the receive-filtering portion and the transmit-filtering portion.

With such a structure, the frequency characteristics related with the resonators are determined by capacitances in the dielectric block. The capacitances in turn depend upon geometries of the conductive electrodes on the front surface of the dielectric block.

Advancements in the field of mobile communication have required that the monoblock dielectric duplexer be smaller and mass-producible. However, if the physical dimension of the monoblock dielectric duplexer is reduced, the conductive electrodes formed on the duplexer must be correspondingly reduced. For smaller electrodes to provide the same capacitances, the intervals between them must be reduced. However, for manufacturing reasons, minimum intervals are required between them, so that there is a limit to reducing the intervals. Moreover, even if the capacitances are set by varying the shape or intervals of the conductive electrodes, it is difficult to design the geometries of the conductive electrodes to set desired capacitances since the capacitance between adjacent resonators and the capacitance between each of the resonators and the conductive materials of the side surfaces must be simultaneously altered. A number of modeling experiments have been required to finally provide desired capacitances in conventional monoblock duplexers, thereby increasing the production cost.

SUMMARY OF THE INVENTION

It is, therefore, a primary object of the present invention to provide an improved monoblock dielectric duplexer having such a structure that is capable of setting capacitances of the duplexer in accurate manner by finding out the relation between capacitances and the geometries of the conductive electrodes thus to improve productivity thereof.

Another object of the present invention is to provide an improve monoblock dielectric duplexer having conductive electrodes for use in precisely adjusting geometries thereof, whereby the duplexer can be small and manufactured in a simplified manner.

Still another object of the present invention is to provide an improve monoblock dielectric duplexer having conductive electrodes that adapted to set desired capacitances when the number of resonator for a transmit filter and the number of resonator for a receive filter are same, thereby to facilitate mass-product.

In accordance with one aspect of the present invention, therefore, there is provided a monoblock dielectric duplexer comprising:

- a dielectric block covered with conductive material except for one side;
- a first group of resonant holes bored inside the dielectric block for a transmit filter, the holes being arranged in parallel with one another;
- a second group of resonant holes bored inside the dielectric block for a receive filter, the holes being arranged in parallel with one another;
- a first conductive pattern, on the one side, surrounding the openings of the first group of resonant holes, and a second conductive pattern, on the one side, away from the opening of the first group of resonant holes, the first and second patterns being spaced apart and having fingers; and
- a third conductive pattern formed on the side to surround the openings of the second group of resonant holes, and a fourth conductive pattern formed to the side away from the openings of the second group of resonant holes, the third and fourth patterns being spaced apart and having no fingers.

The duplexer may further comprise a transmit coupler, an antenna coupler and a receive coupler formed on the one side, wherein the transmit coupler formed adjacent to a first electrode of the first conducive pattern, the transmit coupler and the first electrode of the first conducive pattern being spaced apart and having no fingers, the receive coupler formed adjacent to a first electrode of the third pattern, the receive coupler and the first electrode of the at least one third pattern being spaced apart and having no fingers, and the antennal coupler formed between the first group of the holes and the second group of the holes.

Preferably, in the duplexer, the number of the first group of resonant holes and the number of the second group of resonant holes are the same, and the diameters of the resonant holes are identical to the intervals between the first group of resonant holes and the interval between two center holes, one each from the transmitting portion and the receiving portion, is different from the intervals. The antenna coupler may be branched with one branch closer to the transmitting portion and the other closer to the receiving portion.

BRIEF DESCRIPTIONS OF THE DRAWINGS

The above and other objects and features of the present invention will become more apparent from the following description of preferred embodiments given in conjunction with the accompanying drawings, in which.

Figure 1:
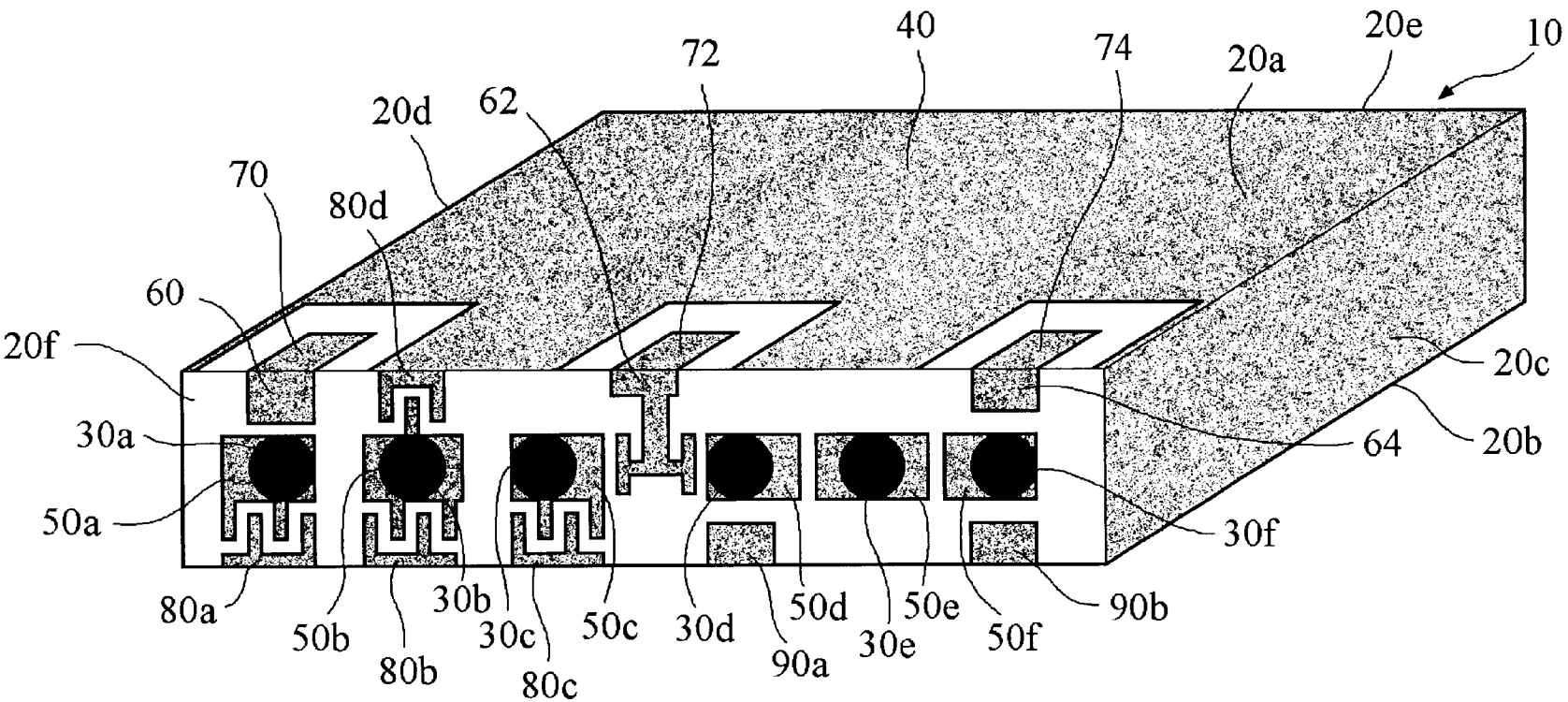
FIG. 1 is a perspective view of a monoblock dielectric duplexer of a preferred embodiment of the present invention.
Figure 3A:
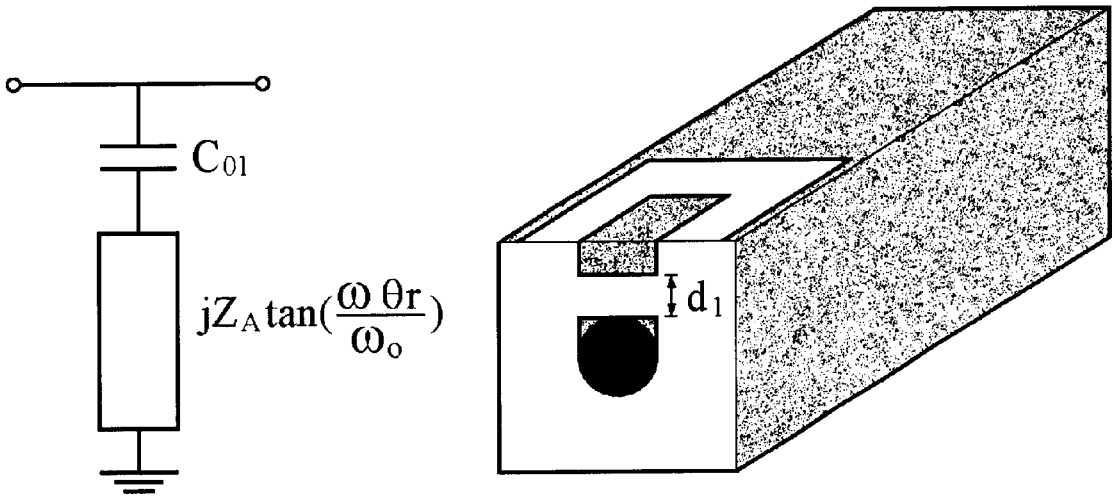
FIG. 3A shows an equivalent circuit and its corresponding structure model for analysis of a capacitor $C_{01}$ provided between a resonator and a terminal on the receive-filtering portion/transmit-filtering portion in the dielectric duplexer shown in FIG. 1.
Figure 3B:
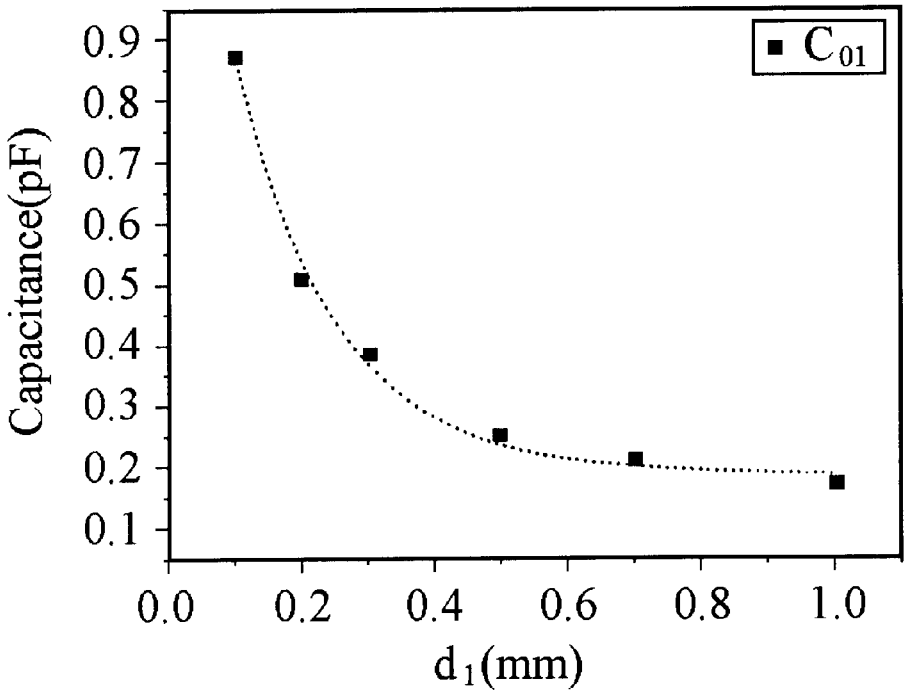
Figure 4A:
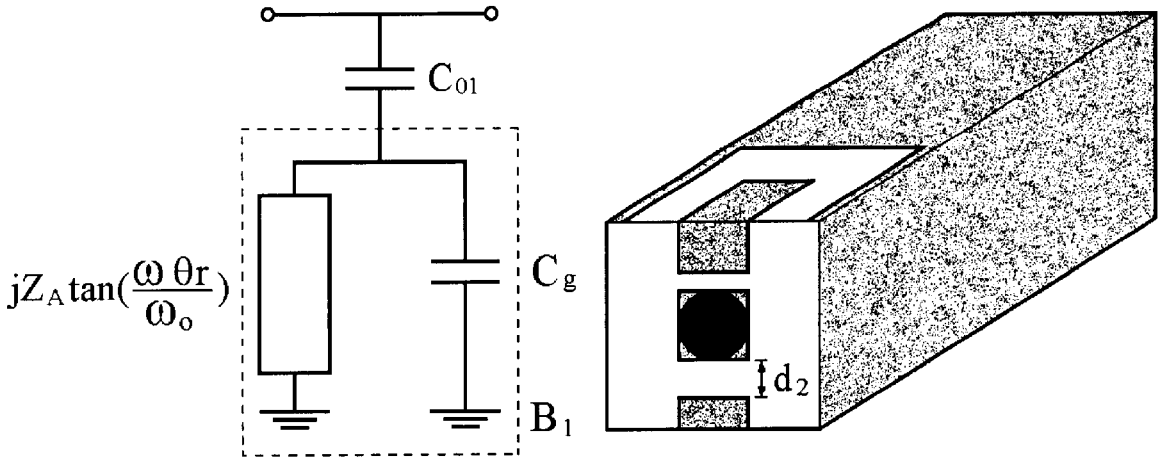
Figure 4B:
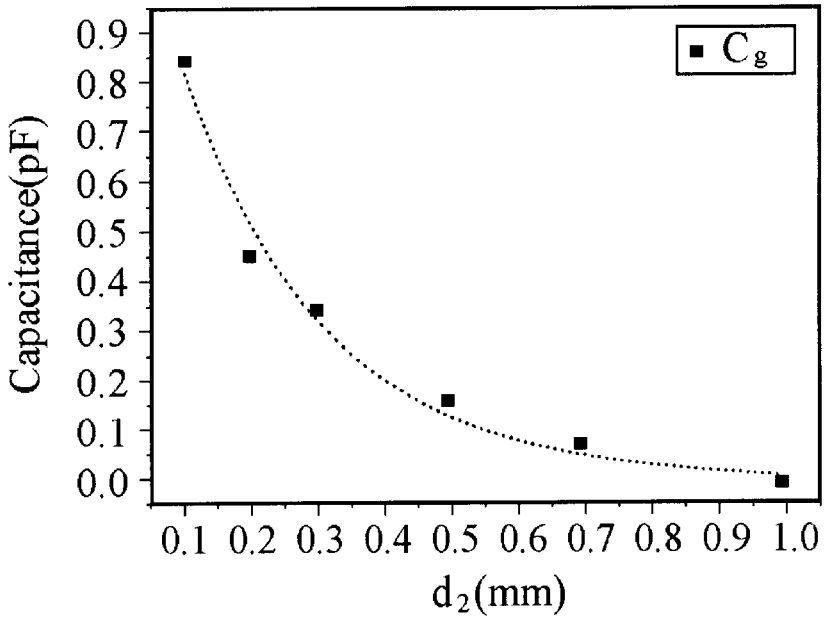
Figure 5A:
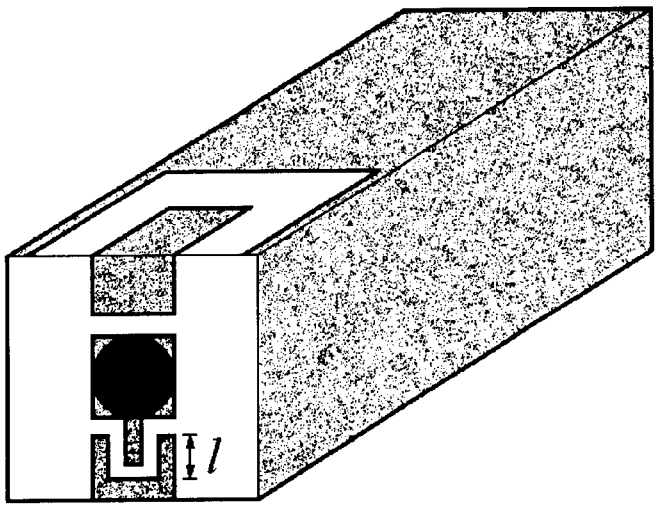
Figure 5B:
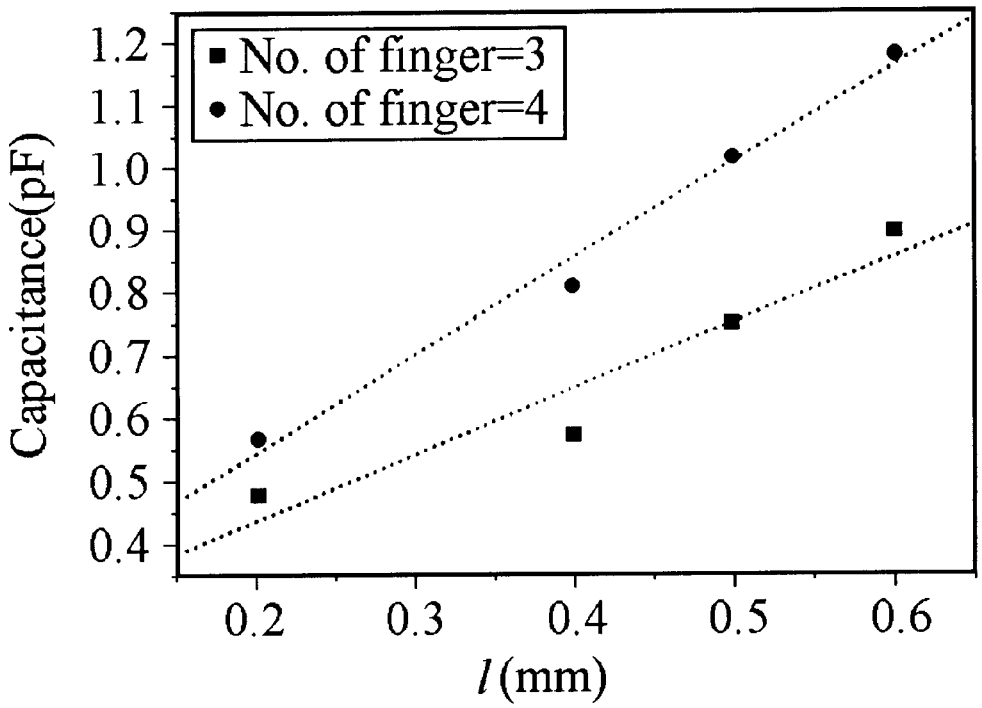
Figure 6:
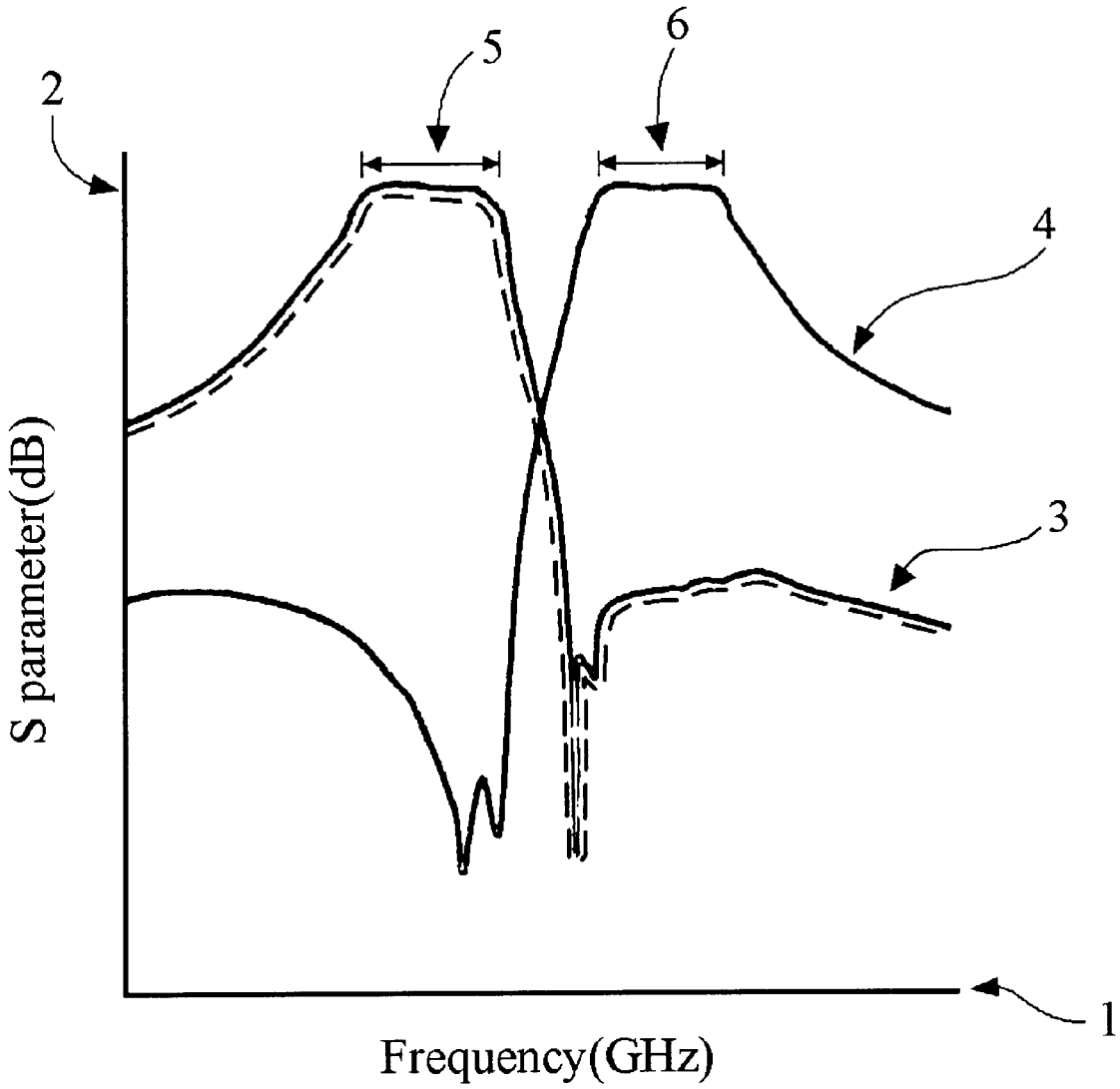

FIG. 3B offers a graph showing capacitance obtained by varying interval $d_1$ between electrodes of the capacitor $C_{01}$ in FIG. 3A;

FIG. 4A shows an equivalent circuit and its corresponding structure model for analysis of a pad-type capacitor $C_g$ provided between a resonator and a ground electrode on the receive-filtering portion in the dielectric duplexer shown in FIG. 1;

FIG. 4B provides a graph showing capacitance obtained by varying interval $d_2$ between electrodes of the capacitor $C_g$ in FIG. 4A;

FIG. 5A shows an equivalent circuit and its corresponding structure model for analysis of an inter-digital capacitor $C_g$ provided between a resonator and a ground electrode on the transmit-filtering portion in the dielectric duplexer shown in FIG. 1;

FIG. 5B illustrates a graph showing capacitance obtained by varying lengths of fingers l with fixing the line width and the interval between the electrodes of the capacitor $C_g$ in FIG. 5A; and FIG. 6 illustrates a graph of frequency characteristics of the monoblock dielectric duplexer shown in FIG. 1.

DETAILED DESCRIPTION OF THE PRESENT INVENTION

The present invention will be described in detail, with reference to the accompanying drawings.

As shown in FIG. 1, the duplexer according to the present invention comprises a flat hexahedral block 10 made of a dielectric material. All its surfaces, except for the front surface 20*f*, are substantially covered with a conductive material, which serves as a ground electrode 40.

Furthermore, the dielectric block 10 has a plurality of resonant holes 30*a*–30*f* bored inside the block from the front surface 20*f* all the way to the rear surface 20*e*, like tunnels, in parallel with each other. All the resonant holes are of a same length. The internal surface of each of the resonant holes 30*a*–30*f* is substantially coated with a conductive material. It is desirable the holes are arranged such that they would be in parallel with one another at a uniform interval. It is also desirable that the diameter of each resonant hole is identical to the distance between adjacent holes, e.g., 1 millimeter (mm), except for the two center holes, e.g., 2 mm. A first group of resonant holes 30*a*–30*c* are for transmission and a second group of resonant holes 30*d*–30*f* are for reception. The two groups have a same number of holes.

On front surface 20*f*, a transmitting coupler electrode 60 and a receiving coupler electrode 64 are disposed on the transmit-filtering portion side and the receive-filtering portion side, respectively. An antenna coupler electrode 62 is formed on the front surface 20*f* between the receive-filtering portion and the transmit-filtering portion. A transmitting terminal 70, a receiving terminal 74 and an antenna terminal 72 are provided on the top surface 20*a* of the duplexer to transmit/receive a signal to/from electrical circuits of an electronic device, on which the duplexer is to be mounted. As shown in FIG. 1, they are electrically separated from the ground electrode 40 and but connected directly to the transmitting coupler 60, the receiving coupler 64 and the antenna coupler 62, respectively, thereby being capacitive coupled to the resonators.

Furthermore, electrodes 50*a*–50*f*, 80*a*–80*d*, 90*a* and 90*b* are formed on front surface 20*f*, each surrounding the opening of a respective resonant hole so as to be connected to the conductive material coated on the internal surface of the resonant hole. As a result, adjacent resonators are capacitance-coupled to each other.

In the present embodiment, all the resonators have the same length. In order for same-length resonators to have different frequency pass bands, it is necessary that the capacitance of the transmit-filtering portion should be different from that of the receive-filtering portion. For this purpose, additional conductive electrodes 80*a*–80*d*, 90*a* and 90*b* are formed on the front surface 20*f* slightly away from the electrodes 80*a*–80*d*, 90*a* and 90*b* respectively so that each pair would form a capacitor.

In the receive-filtering portion, the conductive electrodes 90*a* and 90*b* are formed starting from an edge of on the front surface and extending toward the resonant holes 30*d* and 30*f*. The precise shapes and sizes of the secondary electrodes would be predetermined depending a desired capacitance. Although not shown, another electrode may be similarly formed in connection with the second resonant hole.

In the transmit-filtering portion, the electrodes 80*a*–80*c* are formed on the front surface next to the electrodes 50*a*, 50*b*, and 50*c* respectively. The conductive electrode 80*d* is also formed next to the electrode 50*b* opposite to the electrode 80*b*. The electrodes 50*a*–50*c* and 80*a*–80*d* are capacitively coupled in an interdigitating manner to for large capacitance. The increased capacitance results in the transmission pass band lower than the reception pass band in frequency. In other words, they are formed to take the shape of a comb having multiple fingers. The spacing between each pair of facing electrodes is determined based on desired capacitance. More effectively, the number and length of the fingers of the electrodes can be adjusted until the desired capacitance is achieved. For example, if one wanted a large capacitance, the number of the fingers of the comb-shaped capacitive electrodes could be increased as a way of increasing the surface area of the capacitor. Namely, the capacitance of the transmit-filtering portion can be increased by determining the number and lengths of fingers of electrodes, without increasing the overall size of a duplexer.

The transmitting coupler 60 and the receiving coupler 64 are formed on the front surface 20*f* to form capacitors along with the electrode 30*a* and 50*f* respectively. Their shapes and sizes depend on a desired capacitance. For example, their shapes and sizes are formed to be similar to those of the electrode 90*b* respectively.

In order to reduce the size of the duplexer, the distance between antenna coupler 62 and the electrode 50*c* and the distance between the antenna coupler and the electrode 50*d* should be small. It is noted that the antenna coupler 62 should be designed to increase impedance so as to prevent mutual interference between the transmission signal and the received signal, processed by the transmit-filtering portion and the receive-filtering portion respectively. At the same time, the antenna coupler should be able to prevent undesirable resonance resulting from the increased impedance. In order to meet these requirements the antenna coupler 62 according to the present invention has two branches, facing away from each other and toward two center electrodes 50*c* and 50*d* respectively.

Figure 2:
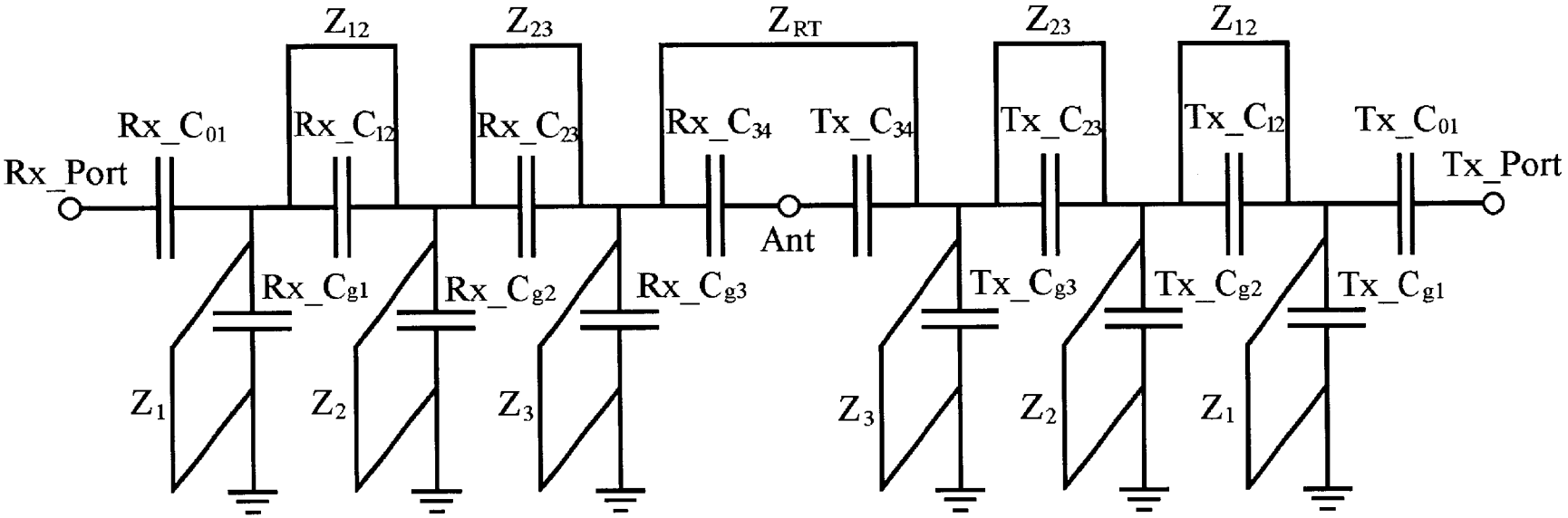
FIG. 2 depicts an electrical schematic diagram of the monoblock dielectric duplexer shown in FIG. 1.

FIG. 2 is a diagram of an equivalent circuit for the monoblock dielectric duplexer shown in FIG. 1. Resonators are represented by transmission lines $Z_1$, $Z_2$ and $Z_3$. Each of the resonators $Z_1$, $Z_2$ and $Z_3$ is grounded in parallel with a respective capacitor, i.e., one of $Rx_C_{g1}$, $Rx_C_{g2}$, $Rx_C_{g3}$, $Tx_C_{g3}$, $Tx_C_{g2}$ and $Tx_C_{g1}$. The left half of the circuit represents the receive-filtering portion. Rx_Port indicates the receiving terminal of the duplexer. On the other hand, the transmit-filtering portion is represented at the right half of the circuit. Tx_Port indicates the transmitting terminal of the duplexer. The receive-filtering portion and the transmit-filtering portion are commonly connected via capacitors to the antenna terminal Ant shown at the center of FIG. 2.

Capacitors $Rx_C_{01}$ and $Tx_C_{01}$, connected to the receiving terminal Rx_Port and the transmitting terminal Tx_Port, are used as input-coupling and output-coupling capacitors, respectively. Capacitor $Rx_C_{12}$ is a coupling capacitor located between the resonators $Z_1$ and $Z_2$ while capacitor $Rx_C_{23}$ is a coupling capacitor located between the resonators $Z_2$ and $Z_3$, both in the receive-filtering portion. Capacitor $Rx_C_{34}$ is a coupling capacitor located between the antenna terminal Ant and the resonator $Z_3$. Similarly, capacitor $Tx_C_{12}$ is a coupling capacitor located between the resonators $Z_1$ and $Z_2$ while capacitor $Tx_C_{23}$ is a coupling capacitor located between the resonators $Z_2$ and $Z_3$, both in the transmit-filtering portion. Capacitors $Tx_C_{34}$ is a coupling capacitor located between the antenna terminal Ant and the resonator $Z_3$ of the transmit-filtering portion.

The resonators represented by transmission lines $Z_1$, $Z_2$ and $Z_3$ are electromagnetically coupled to their adjacent resonators. For example, electromagnetic coupling line $Z_{12}$ connects the resonators $Z_1$ and $Z_2$. Similarly, electromagnetic coupling line $Z_{23}$ connects the resonators $Z_2$ and $Z_3$. And, electromagnetic coupling line $Z_{RT}$ connects the two resonators $Z_3$ one each from the receiving and transmitting sides.

From now on, a procedure for computing the capacitance of each capacitor in FIG. 2 will be explained in detail.

The even-mode characteristic impedance and odd-mode characteristic impedance represent the characteristic impedance of each resonator. In the preferred embodiment of the invention, the resonant holes in the dielectric block are of a same size (i.e., same diameters and lengths), and the receive-filtering portion and the transmit-filtering portion are symmetrical with respect to the center. In such a structure, $Z_{12}$ is equal to $Z_{23}$. Thus, the capacitances of the capacitors in FIG. 2 can be calculated by the following equations:

$$C_{01} = \frac{J_{01}}{\omega_0\sqrt{1-\left(\frac{J_{01}}{G_B}\right)^2}} \quad \text{Eq. (1)}$$

$$C_{12} = \frac{J_{12} + Y_{12}\cot\theta_\gamma}{\omega_0} \quad \text{Eq. (2)}$$

$$C_{23} = \frac{J_{23} + Y_{23}\cot\theta_\gamma}{\omega_0} \quad \text{Eq. (3)}$$

-continued $$C_{34} = \frac{J_{34}}{\omega_0\sqrt{1-\left(\frac{J_{34}}{G_B}\right)^2}} \quad \text{Eq. (4)}$$

$$C_{gj}\Big|_{j=1\sim n} = \frac{Y_j\cot\theta_\gamma}{\omega_0} \quad \text{Eq. (5)}$$

wherein J is representative of a J-inverter, i.e., the admittance inverter used for constructing a filter only with parallel resonators instead of with serial and parallel resonators; $\omega_0$ is the angular frequency at the center of the pass band of the resonance filter; Y is the characteristic admittance of the transmission lines; $\theta_\gamma$ is the electrical length of the transmission lines at the angular frequency at the center of the pass band of the resonator filter; and $G_A$ and $G_B$ are input conductance and output conductance, respectively.

More specifically, FIG. 3A shows an equivalent circuit for analysis of a capacitor $C_{01}$ provided between a resonator and a terminal in the dielectric block shown in FIG. 1. FIG. 3B is a graph showing capacitances measured by varying the interval $d_1$ between the electrodes of the capacitor $C_{01}$ as shown in FIG. 3A when the width of the electrodes set at 1 mm. Using the resonance angular frequency and the notch angular frequency obtained by the finite element method, the capacitance of the capacitor $C_{01}$ can be calculated by the following equation:

$$C_{01} = \frac{1}{\omega_n Z_A \tan\left(\frac{\omega_n\theta_\gamma}{\omega_0}\right)} \quad \text{Eq. (6)}$$

wherein $\omega_n$ is the notch angular frequency; $\omega_0$ is the resonance angular frequency; $\theta_\gamma$ is the electrical length of the resonator; and $Z_A$ is the characteristic impedance of the resonator.

FIG. 4A shows an equivalent circuit for analysis of a pad-type capacitor $C_g$ provided between a resonator and the ground electrode on the receive-filtering portion in the dielectric block shown in FIG. 1. FIG. 4B is a graph showing capacitances measured by varying the interval $d_2$ between the electrodes of the capacitor $C_g$ in FIG. 4A when the width of the electrodes set at 1 mm. Using the resonance angular frequency and the notch angular frequency obtained by the finite element method, the capacitance of the capacitor $C_g$ can be calculated by the following equation:

$$C_g = \frac{1}{\omega_0 Z_A \tan\theta_\gamma} \quad \text{Eq. (7)}$$

wherein $\omega_0$ is the resonance angular frequency; $\theta_\gamma$ is the length of the resonator; and $Z_A$ is the characteristic impedance.

FIG. 5A shows an equivalent circuit for analysis of an inter-digital capacitor $C_g$ provided between a resonator and the ground electrode on the transmit-filtering portion in the dielectric block shown in FIG. 1. FIG. 5B is a graph showing capacitances measured by varying the lengths l of fingers (shown for 3 and 4 fingers) with the width of the fingers and the interval between the electrodes of the capacitor fixed.

The graph of FIG. 5B shows that the capacitance of the capacitor having four fingers is higher than that having three fingers when the lengths l of the fingers are all the same. Additionally, capacitance lineally increases as the lengths l of the fingers increase.

As discussed above, a change in capacitances depending on varied intervals of electrodes and the number and the lengths of fingers can be predicted from the graphs shown in FIG. 3B, FIG. 4B and FIG. 5B. Thus, it is possible to accurately estimate and decide desired capacitance taking advantage of the linearity of capacitance change depending on a varying pattern of capacitor electrodes. Especially, in case that the number or lengths of fingers increase while the width of electrodes and the intervals of coupling lines are fixed, the capacitance linearly increases. Therefore, from these characteristics, the number and lengths of fingers can be determined to obtain desired capacitance. Thus, by determining the intervals between the electrodes, the number and lengths of fingers, the capacitors are easily implemented to have desired capacitance. In other words, a single dielectric block duplexer can be designed to have desired capacitances in accurate manner by computing the geometries of the capacitors on the basis of the desired capacitances.

FIG. 6 is a graph illustrating the frequency characteristic f a monoblock dielectric duplexer according to the present invention. The X-axis 1 represents frequency (in giga hertz (GHz)) and the Y-axis 2 represents S parameters $S_{11}$ and $S_{12}$ that are the electric power ratio of an incident wave to a reflected wave. Curve 3 represents the frequency characteristic of the transmit-filtering portion and curve 4 indicates the frequency characteristic of the receive-filtering portion. The flat portion 5 of the curve 3 is the pass band of the transmit-filtering portion and the flat portion 6 of the curve 4 is the pass band of the receive-filtering portion. As can be easily seen from FIG. 6, transmission signals whose frequencies are higher the transmission pass band are significantly attenuated. Likewise, frequency component of received signals below the receive pass band 6 are attenuated. Thus, pass bands 5 and 6 are spaced apart in frequency and do not overlap each other. Furthermore, frequencies of the transmission pass band 5 are lower than those of the received pass band 6.

As mentioned above, in accordance with the present invention, the capacitance change depending on intervals and forms of the electrodes of capacitors can be accurately obtained, so that it is easy to set desired capacitance. In other words, desired capacitance can be set by the geometries of the conductive patterns on open-end surface in the duplexer. In particular, the conductive patterns in the transmit-filtering portion are of an inter-digitating arrangement structure, thereby increasing the capacitance of the transmit-filtering portion. Further, capacitance in the inter-digitating arrangement structure can linearly increase when the number and/or lengths of the fingers increase. Accordingly, the present invention allows one to set desired capacitance merely by adjusting the intervals between the electrodes, or the number or/and lengths of the fingers, thereby implementing the monoblock dielectric duplexer having desired size in easy and simplified manner and improving the productivity of the duplexer, compared with the prior monoblock dielectric duplexer.

While the present invention has been shown and described with respective to the particular embodiments, it will be apparent to those skilled in the art that many changes and modifications may be mad without departing from the spirit and scope of the invention as defined in the appended claims.

What is claimed is:

1. A dielectric duplexer comprising:

a first group of resonant holes for a transmit-filter, the openings of said holes being surrounded by first conductive electrodes; and a second group of resonant holes for a receive filter, the openings of said holes being surrounded by a second conductive electrodes, wherein said first conductive electrodes are formed to be spaced apart from one another and are in the shape of a comb and said second conductive electrodes are formed to be spaced apart from one another and be in the shape of a pad.

2. The dielectric duplexer of claim 1, wherein the number of said first group of resonant holes and the number of the second group of resonant holes are the same.

3. A monoblock dielectric duplexer comprising:

a dielectric block covered with conductive material except for one side;

a first group of resonant holes bored inside said dielectric block for a transmit filter, said holes being arranged in parallel with one another;

a second group of resonant holes bored inside said dielectric block for a receive filter, said holes being arranged in parallel with one another;

a first conductive pattern, on said one side, surrounding the openings of said first group of resonant holes, and a second conductive pattern, on said one side, away from the opening of said first group of resonant holes, said first and second patterns being spaced apart and having fingers; and a third conductive pattern formed on said side to surround the openings of said second group of resonant holes, and a fourth conductive pattern formed to said side away from the openings of said second group of resonant holes, said third and fourth patterns being spaced apart and having no fingers.

4. The duplexer of claim 3, further comprising:

a transmit coupler, an antenna coupler and a receive coupler formed on said one side, wherein said transmit coupler formed adjacent to a first electrode of said first conducive pattern, said transmit coupler and said first electrode of said first conducive pattern being spaced apart and having no fingers, said receive coupler formed adjacent to a first electrode of said third pattern, said receive coupler and said first electrode of said at least one third pattern being spaced apart and having no fingers, and said antennal coupler formed between said first group of the holes and said second group of the holes.

5. The duplexer of claim 4, further comprising:

a transmit terminal, an antenna terminal and a receive terminal formed on a second side of the dielectric monoblock but separating from said conductive material, wherein said transmit terminal is coupled to said transmit coupler, said receiver terminal is coupled to said receive coupler, and said antenna terminal is coupled to said antenna coupler.

6. The duplexer of claim 3, wherein the number of said first group of resonant holes and the number of the second group of resonant holes are the same.

7. The duplexer of claim 3, wherein the diameters of said resonant holes are identical to the intervals between said first group of resonant holes and the interval between two center holes, one each from the transmitting portion and the receiving portion, is different from said intervals.

8. The duplexer of claim 3, wherein said antenna coupler is branched with one branch closer to the transmitting portion and the other closer to the receiving portion.

* * * * *